US006062847A

United States Patent [19]

Pappas

[11] Patent Number: 6,062,847

[45] **Date of Patent: *May 16, 2000**

[54] ANTI-FLASH WICK SUPPORT

[75] Inventor: George G. Pappas, Norwich, Ohio

[73] Assignee: Lumi-Lite Candle Company, Inc., Norwich, Ohio

[ * ] Notice: This patent is subject to a terminal disclaimer.

[21] Appl. No.: 09/201,468

[22] Filed: Nov. 30, 1998

Related U.S. Application Data

[63] Continuation-in-part of application No. 08/833,784, Apr. 9, 1997, Pat. No. 5,842,850.

[51] Int. Cl.[7] ..... F23D 3/16

[52] U.S. Cl. ..... 431/35; 431/291

[58] Field of Search ..... 431/35, 73, 120, 431/197, 204, 220, 221, 222, 288, 289, 291, 315, 323; 362/161

[56] References Cited

U.S. PATENT DOCUMENTS

| | | | |
|---|---|---|---|
| 664,246 | 12/1900 | Ellis . | |
| 1,660,760 | 2/1928 | Murphy . | |
| 1,867,420 | 7/1932 | Root . | |
| 2,481,019 | 9/1949 | Joyce . | |
| 3,036,452 | 5/1962 | Renwick, Sr. et al. . | |
| 3,183,688 | 5/1965 | Sobelson . | |
| 3,236,072 | 2/1966 | Goldszmid . | |
| 3,286,492 | 11/1966 | Frazier, Jr. . | |
| 3,516,774 | 6/1970 | Livingstone . | |
| 3,744,957 | 7/1973 | Wright, Sr. . | |
| 3,797,990 | 3/1974 | Rogers et al. | 431/291 |
| 3,873,263 | 3/1975 | DeCroix | 431/291 |
| 3,910,753 | 10/1975 | Lee . | |
| 4,013,397 | 3/1977 | Neugart . | |
| 4,332,548 | 6/1982 | Linton . | |
| 4,494,926 | 1/1985 | Riha . | |
| 4,878,832 | 11/1989 | Lynch . | |
| 5,193,994 | 3/1993 | Schirneker . | |
| 5,690,484 | 11/1997 | Leonard et al. | 431/291 |
| 5,951,318 | 10/1999 | Chambers et al. | 431/291 |

FOREIGN PATENT DOCUMENTS

| | | | |
|---|---|---|---|
| 3630712 A1 | 3/1988 | Germany . | |
| 291 | 1/1868 | United Kingdom | 431/288 |
| 22640 | 10/1911 | United Kingdom | 431/289 |

*Primary Examiner*—Ira S. Lazarus
*Assistant Examiner*—Sara Clarke
*Attorney, Agent, or Firm*—Frank H. Foster; Kremblas, Foster, Millard & Pollick

[57] ABSTRACT

An anti-flash wick support for a candlewick in a candle is disclosed. The support includes a body and a wick holder. The body has a height and thermal resistance which is selected in order to minimize the risk of flashover.

32 Claims, 8 Drawing Sheets

ANTI-FLASH WICK SUPPORT

CROSS-REFERENCE TO RELATED APPLICATIONS

This application is a continuation and in-part of application Ser. No. 08/833,784, filed Apr. 9, 1997, now U.S. Pat. No. 5,842,850.

BACKGROUND OF THE INVENTION

1. Field of the Invention

The invention relates to candles, and more specifically to a support for a candlewick which makes the flame go out before the fuel exceeds its flashpoint and all of the candle fuel is consumed.

2. Description of the Related Art

Candlewicks function by capillary action drawing a fuel, commonly molten wax, from a pool up through the wick to the flame. The capillary action can be through a fabric or thread wick or through a capillary tube. When the candle fuel pool becomes very shallow, it can become hot enough to vaporize and it no longer needs a wick to burn. This phenomenon is called "flash" or "flashover." Once the upper surface of the wax descends nearly to the floor of the container, the shallow pool of wax can be elevated above its flashpoint temperature, typically about 425° F. with conventional, common waxes. During flashover, the temperature within the candle can be elevated to at least 1200° F. This excessive heat can cause glass containers to break, and it can cause paint to scorch off the sides of metal tins and char surfaces on which they are resting. With freestanding candles, the molten wax pool must not extend through the candle floor, because wax can flow out onto the candle supporting surface. If the wax flows out or the container of a contained candle breaks, supporting or surrounding objects can be ignited.

An additional problem is that debris in the form of carbon balls may form during burning and fall into the wax pool at the bottom of the candle, or the user may allow matches or wick trimmings to fall to the bottom. These foreign objects or debris may aggravate the flashover problem by becoming secondary wicks if they are ignited by the candle flame.

In conventional candles a wick support, such as the sustainer 2 shown in FIG. 1, is often used to provide lateral support to a wick in a candle to hold the wick in place during pouring of the wax or other fuel, and to keep the wick standing upright when the supporting wax around the wick burns very low. The wick is held in a bore formed completely through the sustainer. During burning, molten wax 4 is drawn upwardly through the wick sides initially, and is carried to the flame. As the upper surface of the molten wax 4 descends to near the top end of the sustainer 2, the heat from the flame liquifies the wax all around the sustainer 2. Once this wax is liquified, molten wax 4 can be drawn from beneath the sustainer 2 through the bore and upwardly to the flame. This permits the majority of the wax 4 to be consumed before the flame goes out from lack of fuel. When the depth of the molten wax 4 is sufficiently small, the flashover problem can occur.

Flashover is a problem which causes significant damage and harm. Therefore, the need exists for an inexpensive and simple safety device for preventing, or decreasing the likelihood of, flashover.

BRIEF SUMMARY OF THE INVENTION

The present invention relates to an anti-flash wick support for a candlewick in a candle. A "candle" is defined as a device which burns a solid or liquid fuel, producing a flame which vaporizes the fuel as the fuel is drawn by capillary action to the flame. Examples include solid fuels such as wax, gel, liquid wax or oil candles, polymer fuel candles, oil lamps, and other devices meeting the preceding definition of candle. Each embodiment of the wick support includes a body and a wick holder for securing the candlewick to the body.

In a first embodiment, the body has a height above the bottom of the candle sufficiently greater than 7/16 inch to minimize the risk of flashover. In a second embodiment, the body has sufficient thermal resistance to prevent wax disposed near the bottom of the body from reaching a temperature greater than 425 degrees by conduction of heat from a flame through the body into the fuel.

A number of variations are possible or preferred with either embodiment. The body is preferably at least ½ inch in height from the bottom of the candle. The wick holder is preferably the inner surface of a bore through the body for receiving a wick. The body may be cylindrical, pyramid-shaped, cube-shaped, conical, or frusto-conical.

Figure 1:
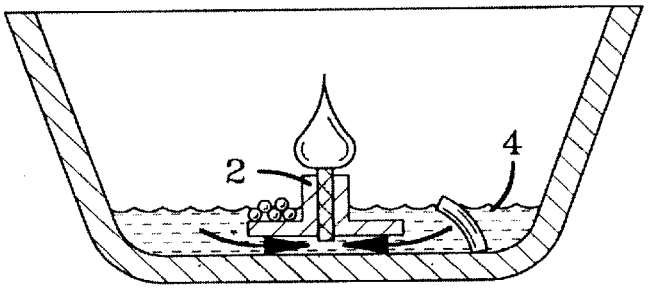
FIG-1 (PRIOR ART)
FIG. 1 is a side view in section illustrating a prior art candle.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE INVENTION

Figure 2:
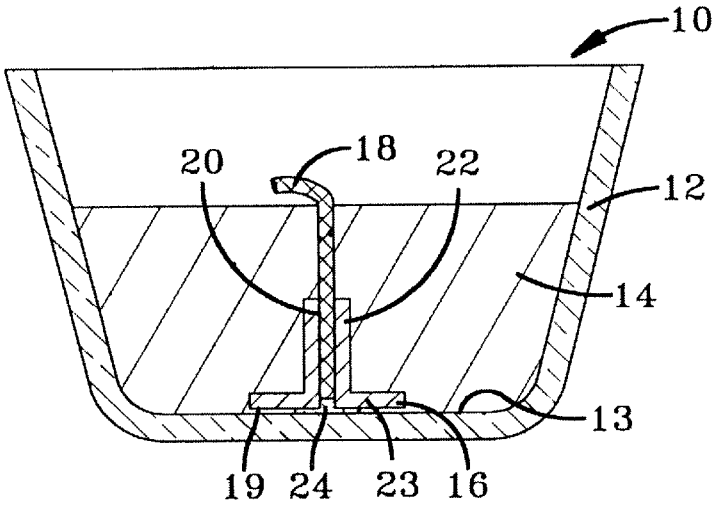
FIG. 2 is a side view in section illustrating a preferred embodiment of the present invention.

The candle 10 of FIG. 2 includes a container 12, a fuel, preferably wax 14, which has been poured into and solidified within the container 12 during manufacture, and a wick 18 mounted to a sustainer 16 at the candle floor. The candle floor is defined as the structure that supports the lowest part of the wax that can become part of the molten wax pool. The candle floor in the candle 10 of FIG. 2 is the container floor 13. The container 12 is a conventional glass jar such as used with container and votive candles, but can be a metal tin or tray.

Figure 7:
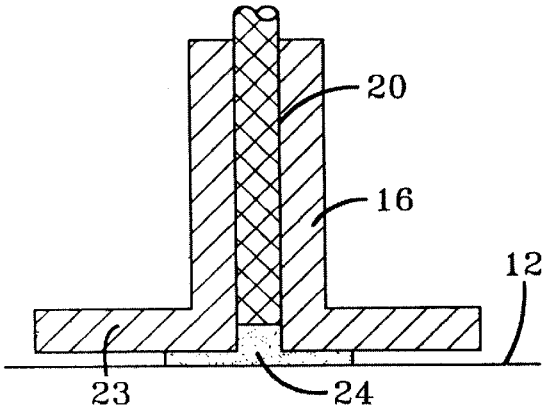
FIG. 7 is a side view in section illustrating the preferred wick sustainer.

The sustainer 16 has an upwardly extending, preferably at least one-half inch tall neck, such as the column 22. The neck is defined as an upright, elongated body, which includes cylinders, cones and parallelepipeds. A cylindrical bore 20 is formed in the sustainer 16 extending from the top end 17 to the bottom end 19 and preferably having a diameter approximately equal to the diameter of the wick 18. The column 22 has an outwardly extending base 23, which is wider than the column 22 to inhibit tipping of the sustainer 16. The sustainer 16 is shown enlarged in FIG. 7.

An adhesive plug 24 is adhered to the bottom end 19 of the base 23, and also to the upwardly facing surface of the floor 13 of the container 12. The plug 24 attaches the sustainer 16 to the floor 13 of the container 12, and functions as a closure to block the bore 20 at its bottom end. The plug 24 is fuel impervious, which is defined as preventing, or significantly restricting, the flow of molten wax and other common candle fuels. The plug 24 prevents or restricts fuel from flowing into the bore 20 where it can be drawn up the wick and burned. The plug 24 therefore serves a dual purpose: blocking fuel from entering the bore 20 from the bottom, and attaching the sustainer 16 to the floor 13. When the sustainer 16 is attached as shown in FIGS. 2, 3, 4 and 6, it also prevents fuel that is being poured into the container 12 during manufacture from displacing the sustainer 16 from its preferred central position, and inhibits tipping of the wick once the hardened wax around it becomes liquified from the heat of burning.

Figure 3:
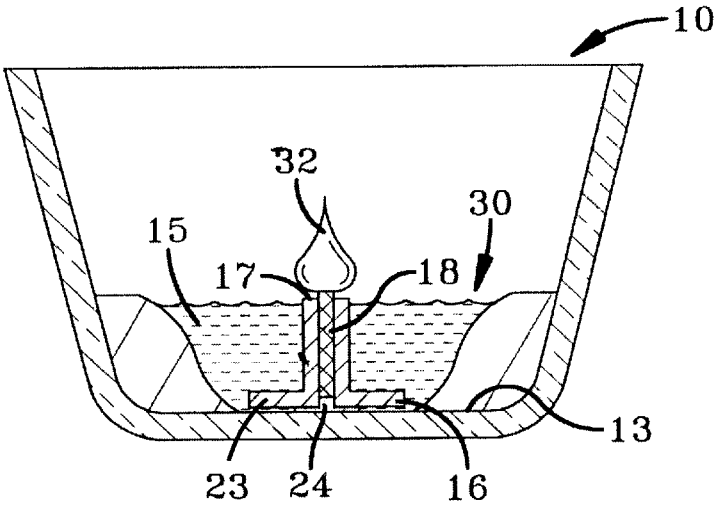
FIG. 3 is a side view in section illustrating the candle of FIG. 2 after significant burning of the candle.
Figure 4:
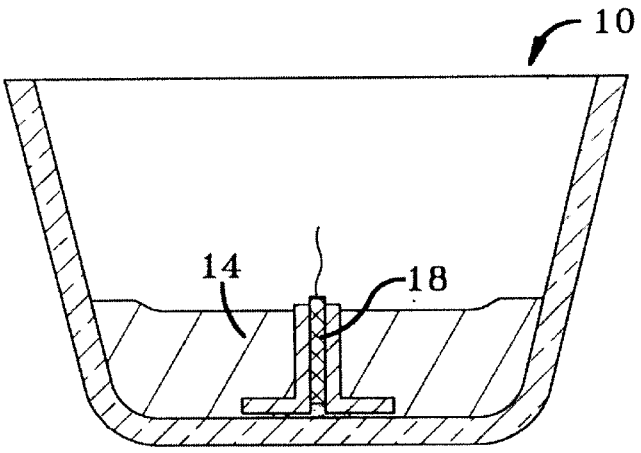
FIG. 4 is a side view in section illustrating the candle of FIGS. 2 and 3 after all available fuel has been consumed.

The candle 10 is shown in FIG. 3 after it has burned for a significant time. The molten wax pool 30 formed around the outside of the sustainer 16 feeds molten wax to the wick 18 as long as its upper surface 15 is at or above the top end 17 of the sustainer 16. The top end 17 of the sustainer 16 is at least approximately one-half inch above the floor 13 of the container 12. Once the upper surface 15 of the wax pool is no longer at or above the top end 17 of the sustainer 16, the wick 18 no longer receives fuel through the sides of the wick 18. Because the adhesive plug 24 prevents the molten wax 30 from being drawn by the wick 18 through the bottom end 19 of the sustainer 16, no fuel is drawn up to the flame and the flame goes out. The candle 10 is shown in FIG. 4 after still further burning. The flame has extinguished due to a lack of fuel, and the molten wax 30 has hardened back into solid wax 14 layer about one-half inch thick.

The preferred sustainer 16 operates in two primary ways to prevent flashover. First, the sustainer 16 has a significant height which, as the wax 14 becomes shallower, keeps the flame far enough above the floor 13 that flashover is inhibited. This sustainer height is preferably at least about one-half inch or greater, but may vary significantly depending upon the type of fuel and its volatility or flashpoints. More volatile fuels may need a taller sustainer to keep the flame higher above the candle floor. Secondly, the sustainer 16 is sealed at the bottom end 19 to prevent, or at least substantially restrict, the flow of fuel through the bore 20 to the flame. This keeps the fuel reservoir from becoming shallow enough for flashover to become more probable than is tolerable. The at least one-half inch tall or taller sustainer ensures that the fuel will not become shallower than about one-half inch, because the flame will go out when it becomes fuel-starved after the top surface of the fuel drops below the one-half inch tall top end. Once the fuel reservoir is shallower than about one-half inch, the likelihood of flashover increases. By preventing the fuel depth from falling below about one-half inch, the likelihood of flashover is significantly reduced.

Figure 5:
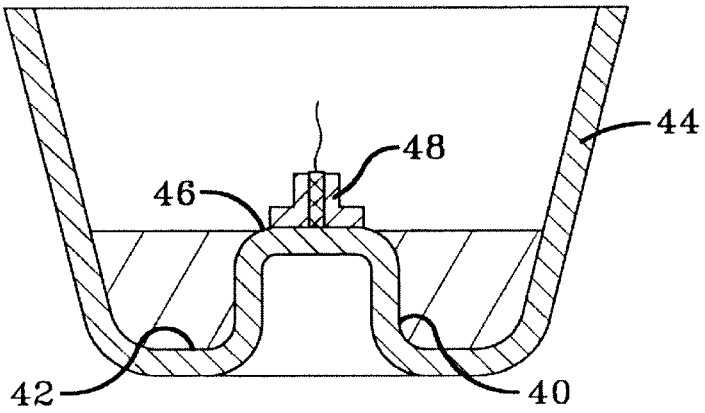
FIG. 5 is a side view in section illustrating an alternative embodiment of the present invention.

Instead of, or in combination with, the preferred sealed sustainer to prevent flashover, an anti-flash pedestal may be mounted to the floor of a container. In FIG. 5, the pedestal 40 is integral with, and extends upwardly from, the floor 42 of the container 44. The container 44 is made of metal, but can alternatively be glass or ceramic. The pedestal 40 has an upper floor 46 which is disposed above the lower floor about one-half to three-quarters of an inch. The upper floor 46 is fuel impervious, and therefore it prevents the flow of fuel into a wick resting on it once the upper surface of the fuel reservoir descends below the upper floor 46. By preventing the fuel from entering the wick, the pedestal 40 starves the candle of fuel and extinguishes the flame.

The pedestal 40 can be formed when the container 44 is initially manufactured. If the container 44 is stamped metal, the pedestal 40 can be stamped into the container 44 during manufacture. If the container 44 is alternatively made of glass, the pedestal 40 can be molded into the container 44. Although it is preferred that the pedestal be integral with the container, a pedestal can be merely attached to an existing container by adhesives, welding, or other known attaching means.

Figure 6:
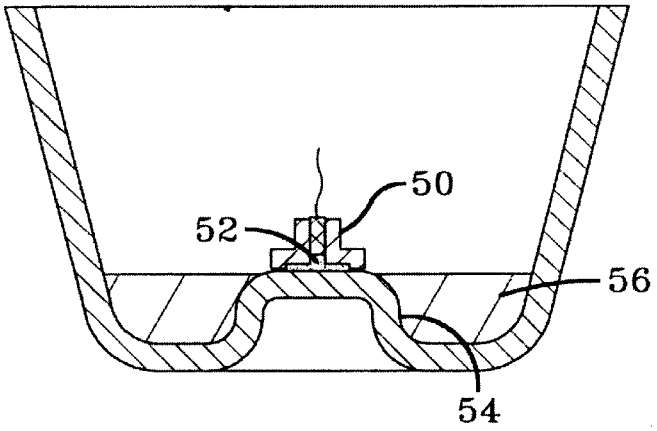
FIG. 6 is a side view in section illustrating another alternative embodiment of the present invention.

When the pedestal 40 has a height of about one-half inch or greater, it can be used in combination with a conventional sustainer 48, as shown in FIG. 5. The floor 46 of the pedestal 40 is fuel impervious and disposed above the lower floor 42 about one-half inch or greater, which alone will cause the flame to go out before flashover becomes too probable. Therefore, the fuel can be consumed down to the base of the sustainer 48 without the depth of the fuel reservoir becoming shallower than about one-half inch. However, there may be situations in which it is advantageous to use a combination of a sealed sustainer 50 having a fuel impervious closure, such as the adhesive plug 52, and a sealed pedestal 54 as is shown in FIG. 6. The sustainer 50 then functions as in the preferred embodiment to cause the flame to go out when the top surface of the wax 56 falls below the top end of the sustainer 50. When used in combination, the pedestal 54 can be shorter than a pedestal used with an unsealed sustainer. The combined. height of the pedestal 54 and sustainer 50 is about one-half inch or greater.

Figure 8:
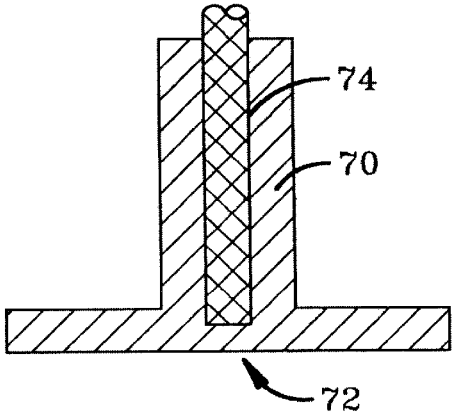
FIG. 8 is a side view in section illustrating an alternative wick sustainer.

An alternative sustainer 70, shown in FIG. 8, has a wall 72 formed at the bottom end of the bore 74. The wall 72 functions as a closure, and can be welded or adhered in position after the bore 74 is formed entirely through the sustainer 70, or the bore 74 can be merely formed partially through the sustainer 70 to leave the wall 72 remaining. The sustainer 70 shown in FIG. 8 is preferred for some candles, such as the freestanding candle 80 shown in FIG. 9. A freestanding candle is defined as a candle having a solid fuel, such as wax, that is not held within a noncombustible container. Freestanding candles do not have to be placed within a container for support, but can be. No container is necessary because, as the fuel is burned, the outer walls of the freestanding candle contain the molten fuel. The freestanding candle 80 shown in FIG. 9 has an at least one-half inch tall sustainer 82, which is essentially identical to the sustainer 70 of FIG. 8. The sustainer 82 is mounted at the candle floor, which for the candle 80 is the surface upon which the bottom of the wax fuel of the candle 80 is resting. This surface can be an attached plate, a container floor, a tray or any horizontal surface. The wick 84 mounts in the sustainer 82, extending upwardly from the bottom end of the bore 86 to the top of the candle 80.

Figure 9:
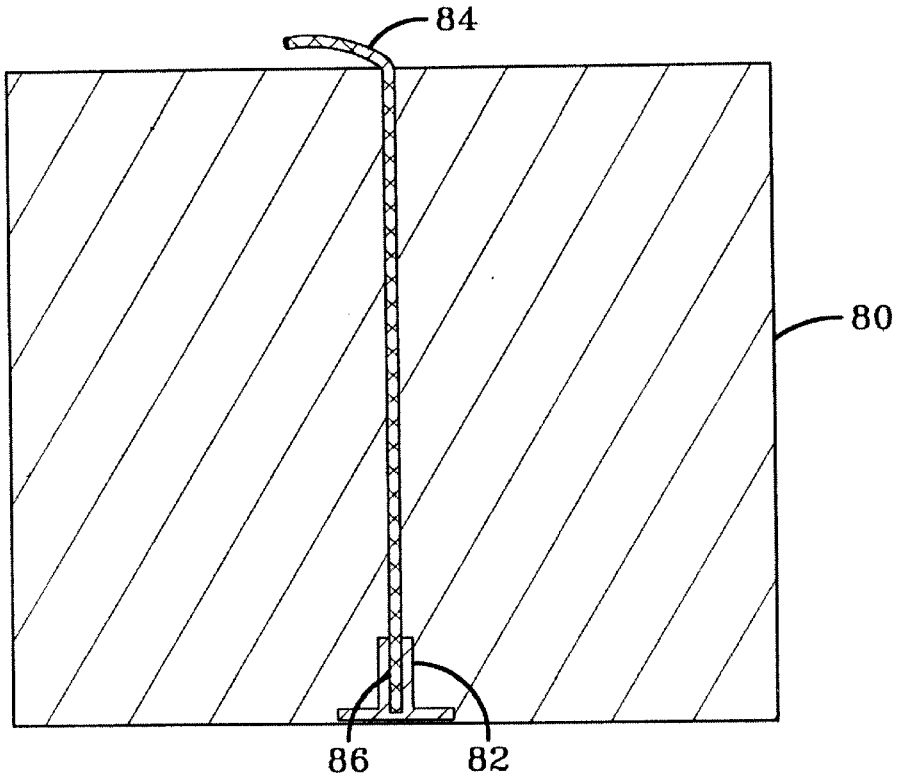
FIG. 9 is a side view in section illustrating a freestanding candle using an alternative embodiment of the present invention.
Figure 10:
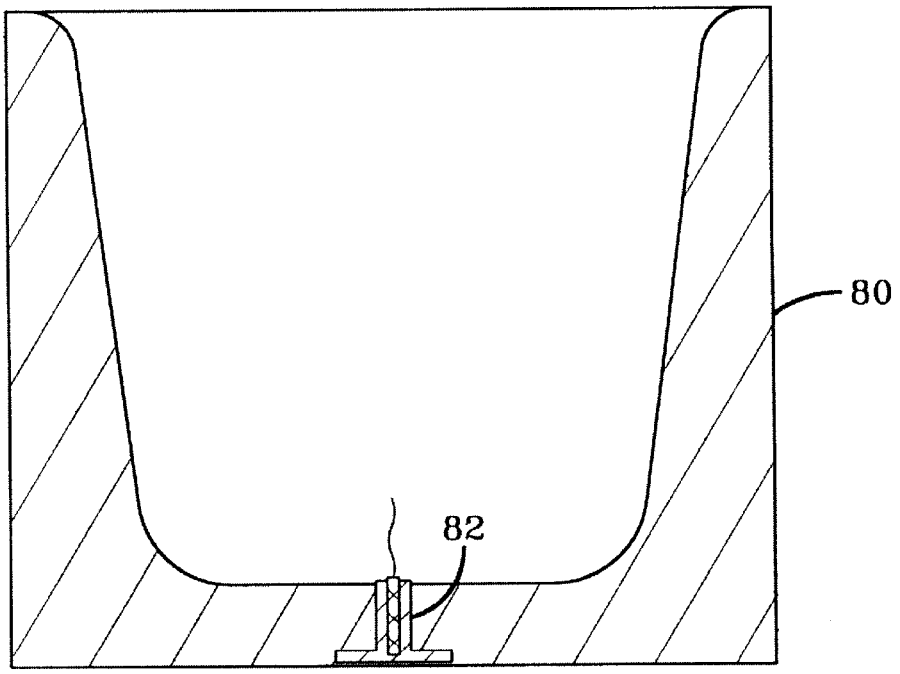
FIG. 10 is a side view in section illustrating the candle of FIG. 9 after significant burning has occurred.

After the candle 80 shown in FIG. 9 has burned for a significant time, it attains the shape shown in FIG. 10. The sidewalls of the candle 80 remain essentially intact as the wick 84 burns downwardly through the center of the candle 80. Since the bottom end of the sustainer 82 is sealed, the flame goes out once the top surface of the fuel descends below the top edge of the sustainer 82.

One danger with freestanding candles is the possibility that the molten pool of fuel will descend to the bottom surface of the candle, and, if the candle is not in a container, the molten fuel will flow onto the candle supporting surface. This danger can be avoided with a sustainer constructed according to the present invention, and with a height large enough to prevent this melt-through problem. Therefore, the sustainer 82 leaves an approximately one-half inch thick reservoir of fuel, preferably wax, and for a freestanding candle a lower portion of this reservoir remains unmelted to prevent the molten wax from flowing out from under the candle 80.

Figure 11:
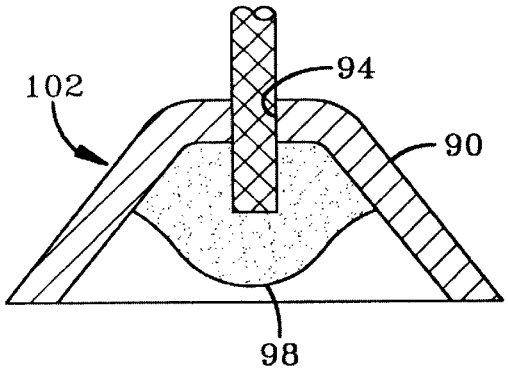
FIG. 11 is a side view in section illustrating an alternative wick sustainer.
Figure 12:
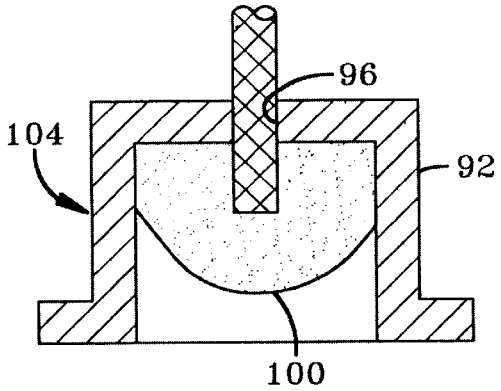
FIG. 12 is a side view in section illustrating an alternative wick sustainer.

Alternative sustainers 90 and 92 are shown in FIGS. 11 and 12. The sustainers 90 and 92 can be used alone or in combination with a pedestal. The sustainers 90 and 92 have central bores 94 and 96, closures 98 and 100, and necks 102 and 104, respectively.

Figure 13:
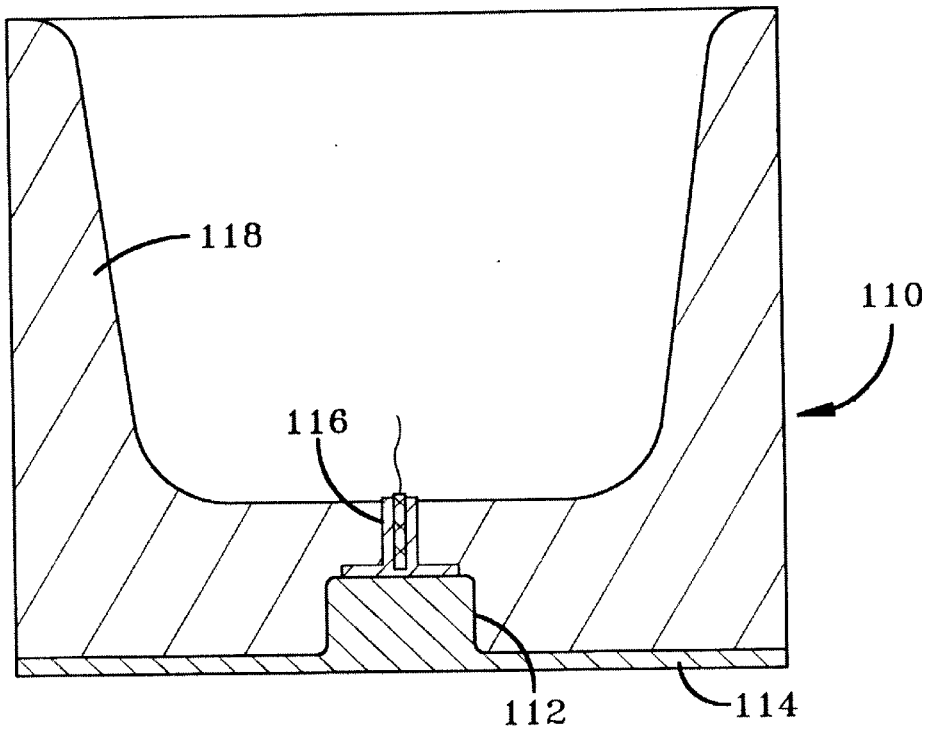
FIG. 13 is a side view in section illustrating a pedestal/sustainer combination in a freestanding candle.

Freestanding candles, such as the candle 80 shown in FIGS. 9 and 10, can also use a pedestal. The pedestal can be used alone or in combination with a sealed sustainer. The candle 110 shown in FIG. 13 has a pedestal 112 attached to a plate 114 mounted to the bottom of the candle 110. The plate 114 with integral pedestal can, for example, be inserted, prior to pouring of the wax, in a mold into which molten wax is poured to form the candle 110. The plate can be made of a noncombustible material or a combustible material, such as wax of the same or a higher melting temperature. The sustainer 116 must be sealed if the top surface of the pedestal 112 is less than about one-half inch above the upper surface of the plate 114, which is the candle floor in this embodiment. The sustainer 116 need not be sealed if the pedestal 112 is one-half inch tall or taller. Alternatively, instead of attaching the pedestal 112 to the bottom of the candle 110 as shown in FIG. 13, the pedestal can be attached to the sidewalls 118 of the candle 110.

Figure 14:
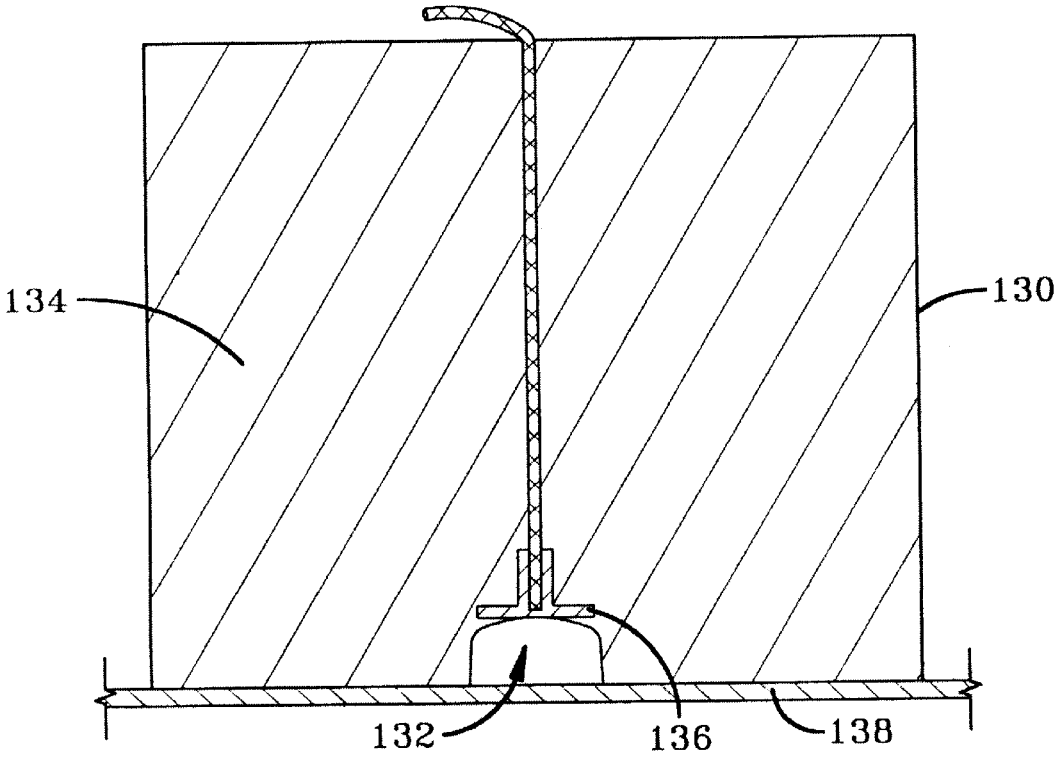
FIG. 14 is a side view in section illustrating an alternative embodiment.

An alternative pedestal structure is shown in FIG. 14. The candle 130 has a concave indentation 132 formed at the bottom of the wax body 134. The sustainer 136, similar to the sustainer 70 of FIG. 8, is held in the wax body 134 by frictional engagement between the outer surface of the sustainer 136 and the wax surrounding the sustainer 136. When the wax surrounding the sustainer 136 melts, the sustainer will fall downwardly into the space formed beneath it, landing on the noncombustible floor 138 and the wax will flow downwardly onto it, extinguishing it. The floor 138 is an attached plate, as illustrated in FIG. 14, but can be substituted by a container floor. If a freestanding candle uses this alternative structure, it must have a floor 138 to prevent the molten fuel which extinguishes the flame from flowing out from under the candle.

Figure 15:
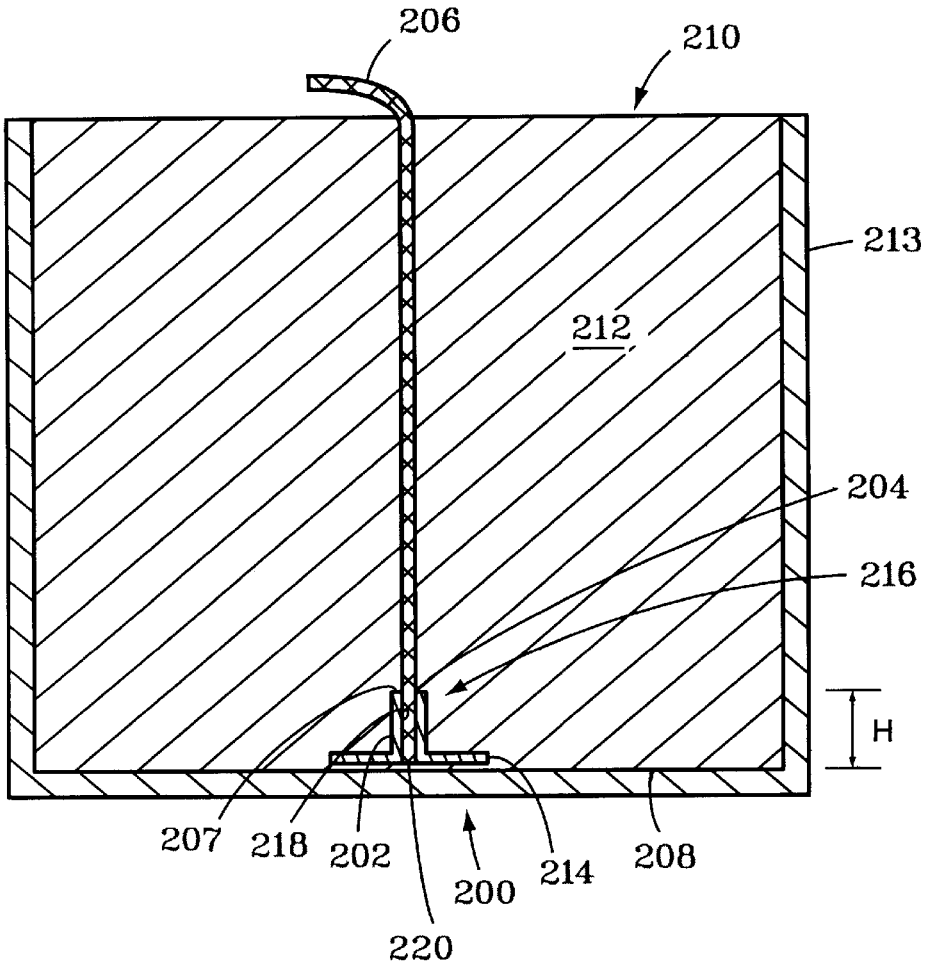
FIG. 15 is a side view in section illustrating yet another alternative embodiment of a support in a candle.

Yet another alternative embodiment is illustrated in FIG. 15. The fuel-impervious closure discussed above is not necessary to minimize flashover if the body of the wick support extends sufficiently far away from the bottom of the candle. Such a wick support maintains the flame above any debris where the flame cannot contact and ignite the debris and also retards heat transfer through the wick support to the surrounding molten wax pool. This embodiment is shown in FIG. 15.

As shown in FIG. 15, the anti-flash wick support 200 includes a body 202 and a wick holder 204. The wick holder 204 secures the candlewick 206 to the body 202. The body 202 has a height H from the top 207 of the body 202 to the bottom 208 of a candle 210 in which the wick support 200 is placed. As mentioned above in connection with previously-described embodiments, the height H may be achieved by the body 202 of the wick support 200 alone, or the height H may be achieved by the placing of the wick support 200 on a pedestal or the like (not shown).

The height H is necessary to minimize or prevent flashover varies with the composition of the fuel 212 from which the candle 210 is made. Each fuel 212 can have a different temperature at which the fuel 212 becomes a vapor. A standard candle 210 is made from a mixture of wax, fragrance, and other trace items, and becomes a vapor at about 425° F. Unless the fuel 212 is heated to that critical temperature, the candle 210 will not flashover.

The fuel 212 from which a typical candle 210 is formed is a solid at room temperature. Once the wick 206 is lit, heat radiates outwardly in all directions from the flame. The heat causes the fuel 212 to melt and be carried by capillary action through the wick 206 to be burned in the flame.

Once much of the fuel 212 of the candle 210 has been consumed, as was shown in FIG. 10, the wick 206 extends only a small distance above the top 207 of the wick support 200. When the flame nears the top 207 of the wick support 200, heat from the flame not only radiates from the flame into the fuel 212, but also travels by conduction through the wick support 200 into the fuel 212 and into any container 213 in which the candle 210 rests. This conduction is a cause of the flashover problem, since the body 202 of the wick support 200 is typically made of metal, and any container 213 in which the candle 210 rests is typically made of metal or glass, both of which conduct heat better than the fuels 212 typically used to form candles 210. Because the containers 213 conduct heat well, the containers 213 can overheat the fuel 212 and cause flashover.

However, if the height H of the body 202 is sufficiently great, the flame is kept high enough that it cannot contact any debris and also heat conducted through the body 202 to the fuel 212 will be insufficient to raise the fuel to a critical temperature of 425° F. If the height H of the top 207 of the body 202 is great enough, the heat will dissipate prior to causing the superheating which is a cause of flashover.

When, for example, sufficient fuel 212 is consumed that the height of the fuel 212 is equal to the height H, if the height H is sufficient, the fuel thickness and mass is still sufficiently great that heat conducted and radiated into this fuel can be dissipated into the air above the fuel and through the container 213 into the surrounding air before the fuel 212 reaches the flashover temperature. Any debris will still be submerged in the pool of liquid fuel where it will not contact the flame and become ignited.

As the fuel 212 continues to move by capillary action through the wick 206 so that it is consumed and the top level of the fuel falls, a greater part of the body 202 becomes exposed to the atmosphere above the fuel 212. This allows a proportion of the heat which is being conducted through the body 202 to be dissipated into the surrounding air. Additionally, there is also less radiation of heat energy into the underlying fuel as the distance between the flame above the top 207 and the fuel surface increases. At a sufficient great height H, the heat which is conducted through the body 202 dissipates sufficiently that it cannot maintain the fuel 212 in a molten condition, and the flame will cease without human action. A height H which is selected to have this property that the wax can not melt to the bottom is greater than 7/16ths of an inch and more preferably on the order of about 1 inch.

As more fuel is consumed and any debris begins to become exposed and protrude above the surface of the molten fuel, the flame is maintained above the height H where it cannot contact and ignite the debris.

The height H which is necessary depends on a variety of variables, including the composition of the fuel 212, as mentioned earlier, and the thermal resistance of the body 202. The thermal resistance of the body 202 depends, at least in part, on the material from which the body 202 is made and the shape and thickness of that material. If the conventional materials are used for both the body 202 and the fuel 212, and the standard configuration and thickness for the wick support 200 are used, as shown in FIG. 15, the necessary minimum height H for the body 202 is about ½ inch. This height H is sufficient to minimize the probability of the fuel 212 near the bottom 214 of the body 202 from reaching the critical temperature of about 425° F. If the body 202 is made from a material with greater thermal resistance, such as ceramic, the height H need not be as great as ½ inch to minimize the risk of flashover.

The use of a height H greater than 7/16 inch is desirable for another reason. When the height H of the body is greater than 7/16 inch, the probability of any debris (not shown), such as carbon balls, dropped matches, and the like, which would have previously fallen into the fuel 212, catching fire, is also decreased. When any debris catches fire, the probability of flashover also increases. Keeping the top 207 of the body 202, and therefore the flame, at least ½ inch above the bottom 208 of the candle 210 reduces the probability of the debris catching fire because the flame is kept sufficiently far from the debris to avoid igniting the debris. A height H of at least ½ inch is therefore desirable, regardless of the other properties of the body 202.

Thus, it can be seen that the invention contemplates applying either or both of two mechanisms for reducing the probability of flashover: making the height H sufficiently long to keep the flame above the debris so it can not ignite the debris; and making the height H sufficiently long that the wax at the very bottom can not melt.

The fuel-impervious closure disclosed above and shown in FIGS. 2–14 is not illustrated in FIGS. 15–18, because it is not necessary if the body is sufficiently high or has a sufficient thermal resistance. As disclosed above, the selection of a body 202 of an appropriate height, thickness, and material prevents the flashover problem by preventing the fuel 212 near the bottom 214 of the body 202 from reaching the critical temperature or flashover temperature. The fuel-impervious closure may, of course, be included for additional security.

As mentioned above, the wick 206 is secured to the body 202 by a wick holder 204. In the embodiments shown in FIGS. 15–18, the wick holder 204 is the inner surface 218 of a bore 220 through the body 202 for receiving a wick 206. It is preferable that the diameter of the bore 220 be about the same as the diameter of the wick 208. One alternative embodiment for the wick holder 204 is to include a clamp or other item on the top 207 of the body 202 which holds the wick 206.

Figure 16:
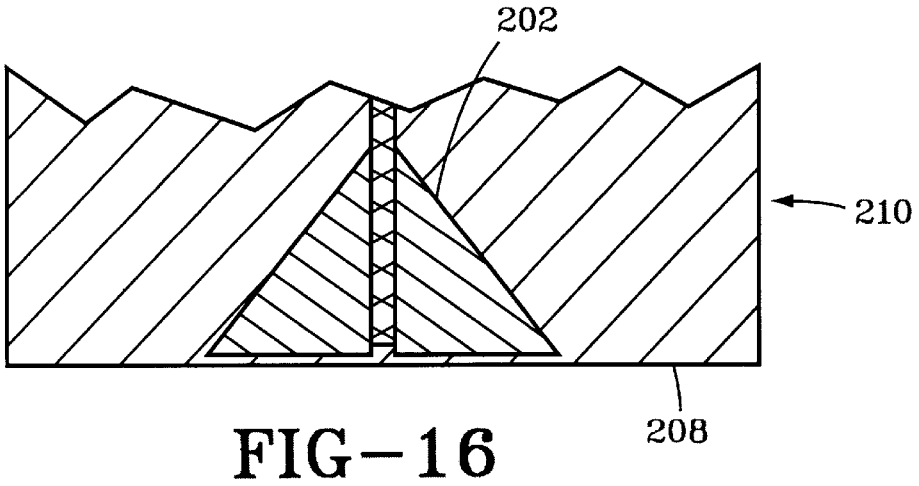
FIG. 16 is a partial side view in section illustrating yet another alternative embodiment of a support in a candle.
Figure 17:
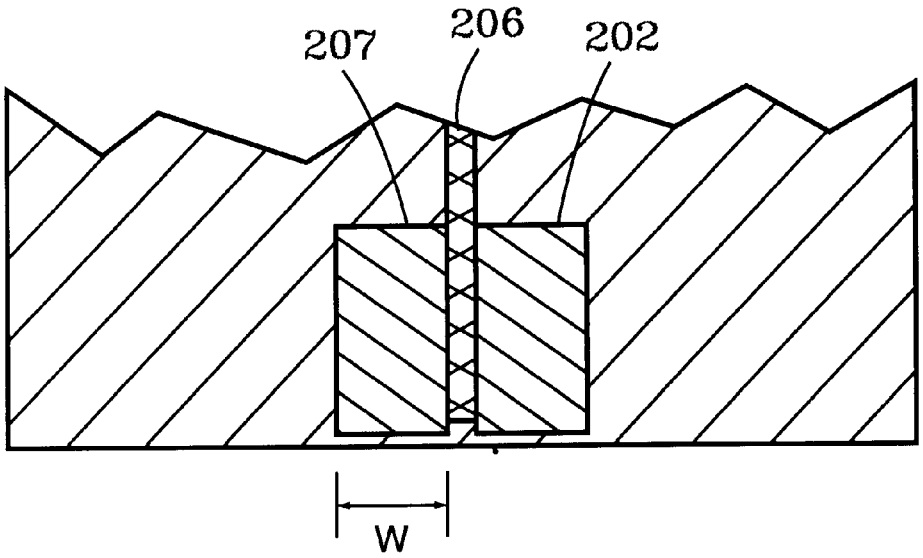
FIG. 17 is a partial side view in section illustrating yet another alternative embodiment of a support in a candle.
Figure 18:
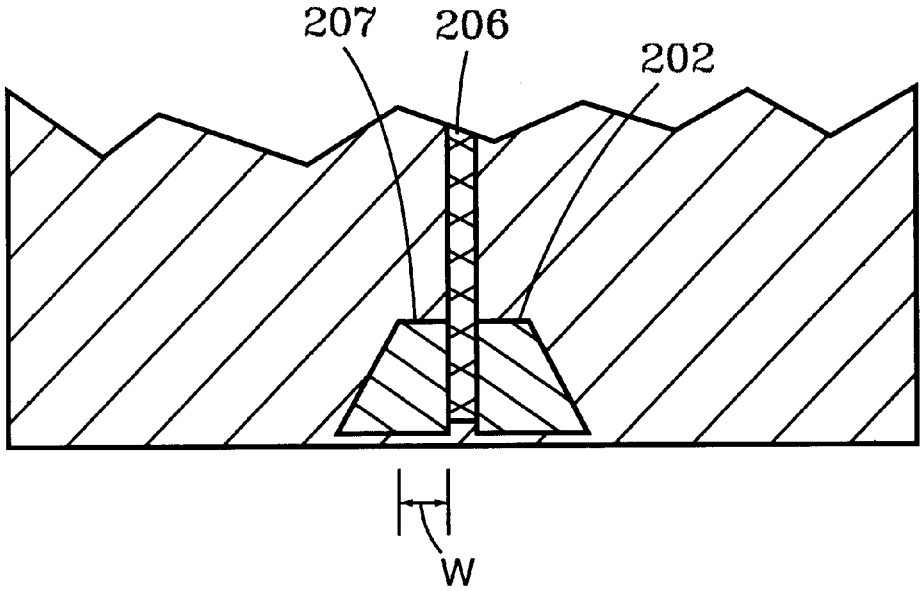
FIG. 18 is a partial side view in section illustrating yet another alternative embodiment of a support in a candle.

FIGS. 16–18 show, in partial cross-section, alternative configurations for the body 202. FIG. 16 illustrates the cross section of a pyramid-shaped or conical body 202. The use of a pyramid-shaped or conical body 202 is particularly desirable, since any carbon balls or other debris (not shown) which would fall into the fuel 212 and eventually fall to the bottom 208 of the candle 210 will tend to be guided away from the area near the flame. Thus, the use of a cone or pyramid shape tends to reduce the probability of flame impingement on the debris.

FIG. 17 illustrates the cross-section of a cylindrical or cube-shaped body 202. FIG. 18 illustrates the cross-section of a frusto-conical body 202. In each of the embodiments of FIGS. 16–18, the body 202 has properties identical to those described in connection with FIG. 15, except that the overall shape of the body 202 differs. A problem which may exist when the embodiments of FIGS. 17 and 18 are used is the width W of the top or neck 207 of the body 202. The greater the width W of the top or neck 207 of the body 202, the greater the probability for debris to remain on the neck 207 of the body 202 and light when the wick 206 becomes short and nears the top 207 of the body 202. Thus, embodiments which include a wider neck 207 are less preferred.

While certain preferred embodiments of the present invention have been disclosed in detail, it is to be understood that various modifications may be adopted without departing from the spirit of the invention or scope of the following claims.

What is claimed is:

1. An anti-flash wick support for a candle wick in a candle, comprising:

(1) a body having a height above a bottom of a candle sufficiently greater than 7/16 inch to minimize the risk of flashover; and (2) a wick holder for mounting the candle wick to the body.

2. The anti-flash wick support for a candle wick in a candle according to claim 1, wherein the body has a height of at least ½ inch.

3. The anti-flash wick support for a candle wick in a candle according to claim 1, wherein the wick holder comprises an inner surface of a bore through the body for receiving a wick.

4. The anti-flash wick support for a candle wick in a candle according to claim 1, further comprising a fuel impervious closure mounted to a bottom end of the body for preventing fuel from contacting the candle wick.

5. The anti-flash wick support for a candle wick in a candle according to claim 1, wherein the body is cylindrical.

6. The anti-flash wick support for a candle wick in a candle according to claim 1, wherein the body is pyramid-shaped.

7. The anti-flash wick support for a candle wick in a candle according to claim 1, wherein the body is cube-shaped.

8. The anti-flash wick support for a candle wick in a candle according to claim 1, wherein the body is conical.

9. The anti-flash wick support for a candle wick in a candle according to claim 1, wherein the body is frusto-conical.

10. An improved container candle having a container with an open top, sidewalls and a bottom, the container containing a solidified fuel with a candle wick extending downwardly into the fuel, the container top being sufficiently open to permit a candle flame to move down the wick above the top surface of the fuel as the fuel is consumed, wherein the improvement is an anti-flash apparatus comprising:

a pedestal extending upwardly from the bottom and having a fuel impervious floor surface supporting the wick.

11. A container candle in accordance with claim 10, wherein the pedestal extends upwardly from the bottom sufficiently high to prevent flashover.

12. An anti-flash wick support for a candle wick in a candle made of fuel, comprising:

(1) a body having a thermal resistance sufficient to prevent fuel disposed near a bottom of the body from reaching a temperature greater than a critical temperature of the fuel by conduction of heat from a flame through the body into the fuel;

(2) a wick holder for mounting the candle wick to the body; and (3) a fuel-impervious closure mounted to a bottom end of the body for preventing fuel from contacting the candle wick.

13. The anti-flash wick support for a candle wick in a candle according to claim 12, wherein the wick holder comprises an inner surface of a bore through the body for receiving a wick.

14. The anti-flash wick support for a candle wick in a candle according to claim 12, wherein the body is cylindrical.

15. The anti-flash wick support for a candle wick in a candle according to claim 12, wherein the body is pyramid-shaped.

16. The anti-flash wick support for a candle wick in a candle according to claim 12, wherein the body is cube-shaped.

17. The anti-flash wick support for a candle wick in a candle according to claim 12, wherein the body is conical.

18. The anti-flash wick support for a candle wick in a candle according to claim 12, wherein the body is frusto-conical.

19. The anti-flash wick support for a candle wick in a candle according to claim 12, wherein the body has a height above a bottom of the candle of at least ½ inch.

20. An anti-flash wick support for a candle wick in a candle made of fuel, comprising:

(1) a pyramid-shaped body having a thermal resistance sufficient to prevent fuel disposed near a bottom of the body from reaching a temperature greater than a critical temperature of the fuel by conduction of heat from a flame through the body into the fuel; and (2) a wick holder for mounting the candle wick to the body.

21. The anti-flash wick support for a candle wick in a candle according to claim 20, wherein the wick holder comprises an inner surface of a bore through the body for receiving a wick.

22. An anti-flash wick support for a candle wick in a candle made of fuel, comprising:

(1) a conical body having a thermal resistance sufficient to prevent fuel disposed near a bottom of the body from reaching a temperature greater than a critical temperature of the fuel by conduction of heat from a flame through the body into the fuel; and (2) a wick holder for mounting the candle wick to the body.

23. The anti-flash wick support for a candle wick in a candle according to claim 22, wherein the wick holder comprises an inner surface of a bore through the body for receiving a wick.

24. An anti-flash wick support for a candle wick in a candle made of fuel, comprising:

(1) a frusto-conical body having a thermal resistance sufficient to prevent fuel disposed near a bottom of the body from reaching a temperature greater than a critical temperature of the fuel by conduction of heat from a flame through the body into the fuel; and (2) a wick holder for mounting the candle wick to the body.

25. The anti-flash wick support for a candle wick in a candle according to claim 24, wherein the wick holder comprises an inner surface of a bore through the body for receiving a wick.

26. An anti-flash wick support for a candle wick in a candle made of fuel, comprising:

(1) a body having a thermal resistance sufficient to prevent fuel disposed near a bottom of the body from reaching a temperature greater than a critical temperature of the fuel by conduction of heat from a flame through the body into the fuel, the body having a height above a bottom of the candle of at least ½ inch; and (2) a wick holder for mounting the candle wick to the body.

27. The anti-flash wick support for a candle wick in a candle according to claim 26, wherein the wick holder comprises an inner surface of a bore through the body for receiving a wick.

28. The anti-flash wick support for a candle wick in a candle according to claim 26, wherein the body is cylindrical.

29. The anti-flash wick support for a candle wick in a candle according to claim 26, wherein the body is pyramid-shaped.

30. The anti-flash wick support for a candle wick in a candle according to claim 26, wherein the body is cube-shaped.

31. The anti-flash wick support for a candle wick in a candle according to claim 26, wherein the body is conical.

32. The anti-flash wick support for a candle wick in a candle according to claim 26, wherein the body is frusto-conical.

* * * * *